United States Patent [19]

Regalbuto

[11] Patent Number: 4,850,438

[45] Date of Patent: Jul. 25, 1989

[54] MODULAR PERFORATING GUN

[75] Inventor: John A. Regalbuto, Ft. Worth, Tex.

[73] Assignee: Halliburton Company, Duncan, Okla.

[21] Appl. No.: 246,903

[22] Filed: Sep. 16, 1988

Related U.S. Application Data

[63] Continuation of Ser. No. 48,098, May 7, 1987, abandoned, which is a continuation of Ser. No. 909,999, Sep. 22, 1986, abandoned, which is a continuation of Ser. No. 605,005, Apr. 27, 1984, abandoned.

[51] Int. Cl.[4] ..... E21B 43/117

[52] U.S. Cl. ..... 175/4.56; 29/428; 102/310; 166/55.1; 175/4.6

[58] Field of Search ..... 175/4.6, 4.51–4.56; 166/299, 297, 55.1, 63; 102/317, 318, 275.4, 310; 29/428

[56] References Cited

U.S. PATENT DOCUMENTS

| | | | |
|---|---|---|---|
| Re. 25,407 | 6/1963 | Lebourg | 102/310 X |
| 2,649,046 | 8/1953 | Davis | 102/310 |
| 2,708,408 | 5/1955 | Sweetman | 102/310 |
| 2,766,690 | 10/1956 | Lebourg | 102/310 |
| 2,873,675 | 2/1959 | LeBourg | 102/20 |
| 2,906,339 | 9/1959 | Griffin | 175/4.51 |
| 3,040,659 | 6/1962 | McCullough | 102/318 |
| 3,128,702 | 4/1964 | Christopher | 102/20 |
| 3,209,692 | 10/1965 | Webb | 102/275.4 |
| 3,211,093 | 10/1965 | McCullough et al. | 175/4.6 |
| 3,414,071 | 12/1968 | Alberts | 175/4.51 |
| 3,415,321 | 12/1968 | Venghiattis | 102/310 |
| 3,650,212 | 3/1972 | Bauer | 102/20 |
| 4,071,096 | 1/1978 | Dines | 175/4.6 |
| 4,191,265 | 3/1980 | Bosse-Platiere | 102/310 |
| 4,319,526 | 3/1982 | DerMott | 175/4.6 |
| 4,387,773 | 6/1983 | McPhee | 175/4.6 |
| 4,393,946 | 7/1983 | Pottier et al. | 175/4.56 |
| 4,491,185 | 1/1985 | McClure | 175/456 |
| 4,523,649 | 6/1985 | Stout | 175/4.51 |
| 4,534,423 | 8/1985 | Regalbuto | 175/4.6 |
| 4,541,486 | 9/1985 | Wetzel et al. | 166/297 |
| 4,583,602 | 4/1986 | Ayers | 175/4.52 |

FOREIGN PATENT DOCUMENTS

| | | | |
|---|---|---|---|
| 258201 | 10/1970 | U.S.S.R. | 175/4.55 |

OTHER PUBLICATIONS

Vol. 9 of the Kirk-Othmer Encyclopedia of Chemical Technology, Third Edition (1980), pp. 561–593.

*Primary Examiner*—Hoang C. Dang

*Attorney, Agent, or Firm*—Joseph A. Walkowski; Mark E. McBurney

[57] ABSTRACT

A modular perforating gun employing only secondary explosives therein, of a design permitting guns to be made up in tandem like drill pipe. The tandem guns have no physically connected shaped charge initiating devices therebetween, each gun being actuated by an acceptor booster charge which is initiated by a shaped donor charge at the bottom of the next higher gun.

2 Claims, 2 Drawing Sheets

MODULAR PERFORATING GUN

This application is a continuation, of application Ser. No. 048,098, filed May 7, 1987, which is a continuation of application Ser. No. 909,999, filed Sept. 22, 1986, and which is a continuation of application Ser. No. 605,005, filed Apr. 27, 1984, all of which are now abandoned.

BACKGROUND OF THE INVENTION

It is common practice in the oil and gas industry to "perforate," or make holes in, the casing in a well bore and a producing formation therebehind in order to obtain oil and gas from the well. These perforating operations are most often conducted through the use of a large number of shaped explosive charges which are run into the well bore in perforating guns which maintain the charges in position and also carry a charge initiation system of some sort.

It is common practice in the prior art to assemble the perforating guns close to or at the site of the well to be perforated, which involves placing the charges in brackets or other similar mounting means to properly orient the charges, and running detonating cord or other initiating means to the charges. The mounting means is then inserted in a charge carrier, which comprises a tubular housing having gun ports therein comprising thin-walled areas adjacent the mouths of the shaped charges placed in the carriers The completed assembly of the charges, mounting means, initiating means and housing comprises a perforating gun. When the charges are initiated, the explosive jets pierce the thin-walled areas, the casing, and the producing formation behind the casing.

When more than one perforating gun is to be employed, such as is the case in formations tens or hundreds of feet in thickness, detonating cord, electrical wires or other charge initiating means are strung from one gun to the next throughout the gun string.

Since operations on oil and gas wells may be conducted in remote locations, in extremely bad weather and during all seasons of the year, this prior art approach to assembling a perforating gun from the various components is inconvenient, to say the least. Moreover, if the required number of charges are not present, the operation may be delayed. Such is also the case if it is discovered that the wrong charges have been sent to the well site, charges have been damaged in transit, or are damaged in assembly with the mounting means and/or carrier. Even worse, the use of the wrong charges may not be discovered until after the perforating operation is conducted, and the casing shattered, the formation ruined, or both. Moreover, there is generally not a clean, well-lighted area in which to perform the assembly work, so that the initiating means may not be properly secured to the charges, and connections from one gun to another may be defective. Finally, to assembly hundreds of charges with mounting means, initiating means and housings may take a day or more, which delays the entire producing operation and therefore costs a substantial sum of money.

Over and above the aforementioned disadvantages, however, is the severe safety hazard inherent in assembling the perforating gun components on site and in running a number of guns in tandem, particularly when explosives of high sensitivity, generally called "primary" explosives, are employed in the guns. Primary explosives present a great hazard due to their ease of initiation by fire, electrical or frictional spark, or impact. Moreover, government regulations in most areas of the world make transport of such primary explosives expensive and difficult by restricting the means of transportation which may be employed, as well as severely limiting the quality of explosive which may be transported together. Great property damage, severe personal injury and even death have been caused by premature gun firing while still on the surface at the well site.

SUMMARY OF THE INVENTION

In contrast to the prior art, the present invention comprises a modular perforating gun employing therein only secondary explosives, which are relatively insensitive to elevated temperatures, physical shock, or sparks. The modular perforating gun of the present invention includes a tubular housing having gun ports therein covered by a wall of decreased thickness. Within the housing is a charge holder loaded with shaped charges employing secondary explosive. A detonating cord comprising secondary explosive connects all the charges. At the top of the cord is a booster and a booster pellet acceptor charge. At the bottom of the detonating cord is a small axially disposed downwardly aimed shaped donor charge. The booster, booster pellet and donor charge all contain secondary explosive. Both the booster pellet at the top of the cord and the charge at the cord bottom are covered by cover plates to provide a dustproof, water-resistant chamber wherein the shaped charges are contained. The top of the housing above the upper cover plate is internally threaded, while the bottom of the housing comprises a "nose" having external threads thereon, so that the bottom nose of one housing may be made up into the top of another, much as drill pipe is made up. When several perforating guns of the present invention are made up into a string in such a fashion, the donor charge of the one gun is placed in close proximity to the acceptor charge in the adjacent gun, there being only the two cover plates therebetween. A firing sub including a shaped donor charge therein is made up to the top of the uppermost gun, the firing sub also having an initiation system therein to initiate the donor charge. Such initiation systems are well known in the art, and may employ actuation by impact of a drop bar, by pressure increase in tubing from which the gun string is disposed, electrical actuation, or other well known means. At the bottom of the gun string is a bull plug preferably having a disposable block of wood, cement, rubber or other material therein to absorb the explosive jet from the donor charge of the lowermost gun.

BRIEF DESCRIPTION OF THE DRAWINGS

The modular perforating gun of the present invention will be more fully understood and appreciated by one of ordinary skill in the art by reference to the following detailed description of the preferred embodiment, in conjunction with the accompanying drawings, wherein.

DETAILED DESCRIPTION OF A FIRST PREFERRED EMBODIMENT

Figure 1A:
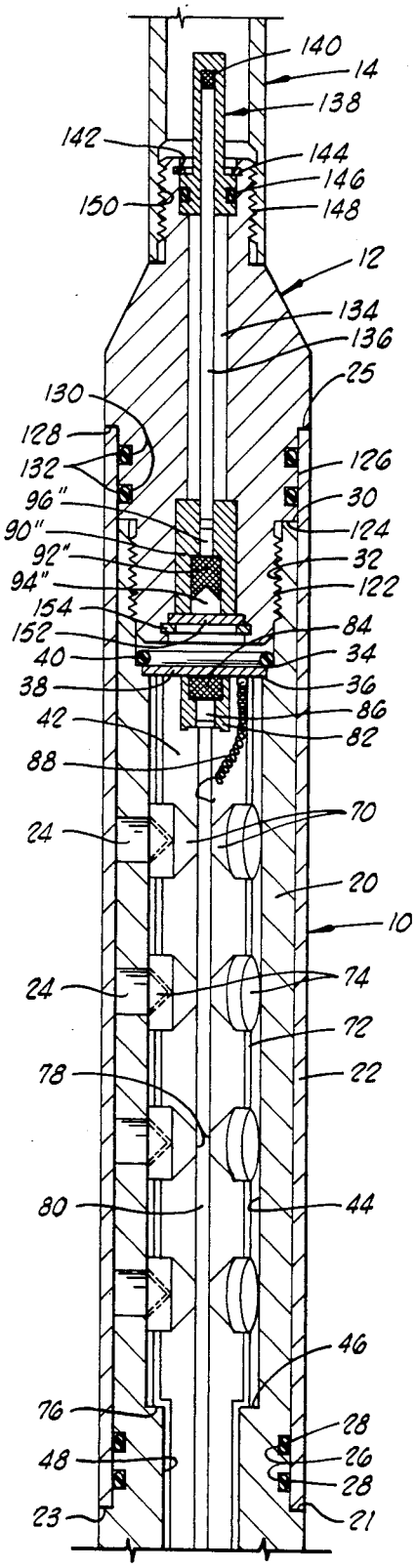
FIGS. 1A and 1B are full sectional schematic vertical elevations of a first preferred embodiment of the present invention.
Figure 1B:
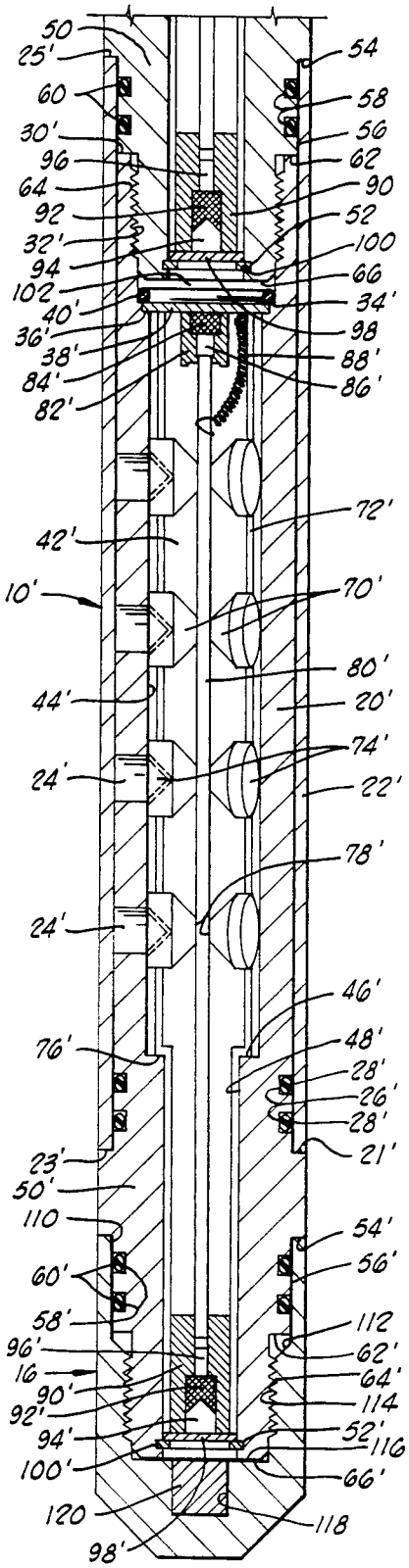

FIGS. 1A and 1B depict two modular perforating guns 10 and 10' of the present invention which are connected to a firing sub 12. Firing sub 12 is in turn suspended from a tubing string 14 by which the guns and firing sub are run into an oil, gas or other well to be perforated such as a water well or steam, $CO_2$, or water injection well. Bull plug 16 is secured to the bottom of gun 10' to enclose the lower end thereof.

Only perforating gun 10 will be described in detail hereafter, gun 10' having substantially identical components thereto.

Perforating gun 10 of the preferred embodiment comprises a tubular housing 20 substantially enclosed within an outer sleeve 22 of lesser wall thickness. Housing 20 possesses apertures 24 through the wall thereof, which apertures 24 are covered by sleeve 22. Apertures 24 serve as gun ports for the explosive jets emanating from shaped charges within gun 10. O-ring grooves 26 at the bottom of housing 20 carry O-rings 28 which bear upon the interior wall of sleeve 22, effecting a fluid-tight seal between housing 20 and sleeve 22. The bottom edge 23 of sleeve 22 abuts annular shoulder 21 on the exterior of housing 20. Sleeve 20 is of substantially the same exterior diameter as housing 20 below shoulder 21, thereby providing a substantially uniform exterior for gun 10.

While O-rings 28 are employed in the preferred embodiment, it should be understood that a seal may be effected between sleeve 22 and housing 20 by welding, brazing, adhesive bonding or other well known means.

At the top of gun 10, sleeve 22 extends beyond the upper end 30 of housing 20, the purpose for which will become apparent hereafter Sleeve 22 may be sized so that it will slide over housing 20, or may be sized for an interference fit, heated, inserted thereover and cooled. However, securing sleeve 22 to housing 20 is not essential to the present invention, as will become more apparent hereafter.

Below upper end 30 of housing 20, internal threads 32 are cut into the inner wall thereof. Below threads 30 is inwardly radially extending annular shoulder 34, below which is another, smaller diameter annular shoulder 36. Circular top cover plate 38 abuts shoulder 36, and is maintained in place by a retaining means 40, which may comprise a large O-ring, a circular spring, a split ring, or other well known retaining means.

Cover plate 38 seals the top of charge chamber 42, which is defined by chamber bore wall 44 of housing 20, chamber 42 extending to annular shoulder 46 at the bottom of wall 44. Below annular shoulder 46, the wall of housing 20 is of increased thickness and the bore wall 48 of lesser diameter, extending through the lower end of housing 20, which may also be referred to as nose 50. Annular groove 52 opens into bore wall 48 proximate the end of nose 50. The exterior of nose 50 at its upper end is of substantially the diameter as sleeve 22, and has annular shoulder 54 cut thereon, below which is cylindrical surface 56 of lesser diameter into which O-ring grooves 58 open. Grooves 58 carry O-rings 60 therein. Below surface 56, shoulder 62 extends radially inwardly to external nose threads 64, which extend substantially to the bottom 66 of nose 50.

On the interior of housing 20, shaped charges 70 are secured in charge holder 72, which may comprise a stamped sheet metal bracket, a cage made of wires, an extruded metal or plastic structure, or other constructions well known in the art. Cover plate 38 may be an integral part of charge holder 72. In the preferred embodiment, charges 70 are shown oriented at 120° intervals, the mouths 74 of charges 70 being aimed by charge holder 72 at apertures 24 when charge holder 72 is fully inserted into housing 20, annular edge 76 abutting shoulder 46. The bottoms 78 of charges 70 are disposed substantially about the central axis of housing 20 in contact with detonating cord 80, which is disposed substantially on the axis of housing 20.

At the top of cord 80 is acceptor booster housing 82, which may be welded, brazed or otherwise secured to top cover plate 38. Booster housing 82 contains acceptor booster pellet 84, below which is booster 86, which is in contact with the upper end of detonating cord 80 clamped or otherwise secured by booster housing 82. Also attached to cover plate 38 is one end of tension spring 88, the other end of which is secured to detonating cord 80 to maintain cord 80 in a substantially taut, unsagging state.

At the bottom of cord 80 is donor booster housing 90, which may be welded, brazed, riveted, screwed, bonded or otherwise secured to charge holder 72. Donor booster housing 90 possesses an axial bore therethrough, in which a small shaped charge 92, referred to as a donor charge, is disposed The mouth of donor charge 92 is aimed downwardly, with a standoff gap 94 at the mouth thereof. The lower end of detonating cord 80 is clamped or otherwise secured proximate booster 96.

Immediately below and adjacent to donor booster housing 90 is circular bottom cover plate 98, which may or may not be secured to housing 90. Below cover plate 98 is expandable retainer ring 100, which snaps into annular recess 52.

Immediately below bottom cover plate 98 of perforating gun 10 is the top cover plate 38' of gun 10', the two plates only being separated by air gap 102. Threads 32' on gun 10' are made up with threads 64 on the nose 50 of gun 10, seals 60 effecting a fluid and pressure-tight seal between nose 50 of gun 10 and sleeve 22' of gun 10', the top end 25' of sleeve 22' abutting shoulder 54 of gun 10.

At the bottom of gun 10' is bull plug 16, of substantially the same exterior diameter as the top end of nose 50'. The upper interior wall 110 of bull plug 16 is cylindrical in configuration, and leads to inwardly downwardly extending oblique annular shoulder 112, from which internal threads 114 extend to the bottom 116 of bull plug 16. At the center of bottom 116 is cavity 118, which may contain a block of metal, cement, rubber, wood or other material 120 to absorb the explosive jet of donor charge 92' of gun 10'. Seals 60' effect a fluid and pressure-tight seal between nose 50' of gun 10' and bull plug 16 when threads 64' are made up with threads 114.

At the top of gun 10 is firing sub 12, which is secured by threads 122 on its lower end to threads 32 on housing 20. Above threads 122 is radially extending annular shoulder 124 above which cylindrical surface 126 extends upwardly to radially extending annular shoulder 128. Above shoulder 128, the exterior of firing sub 12 is of substantially the same diameter as sleeve 22. When gun 10 and firing sub 12 are made up together, seals 132 carried in grooves 130 on firing sub 12 create a pressure and fluid-tight seal, and upper end 25 of sleeve 22 abuts shoulder 126 of sub 12.

The interior of firing sub 12 comprises axial bore 134 at the bottom end of which is donor charge housing 90'', donor charge 92'', standoff gap 94'', and booster 96'', which are substantially identical to the similarly numbered components of gun 10. Donor charge housing 90'' clamps detonating cord 136, which runs upwardly in bore 134 to schematically shown firing head 138, at the top of which is booster pellet 140. Firing head 138 may be designed to initiate booster pellet 140 by an explosive or non-explosive drop bar dropped down tubing string 14 from the surface, by a pressure increase in tubing string 14, by electrical means, by a shaped donor charge lowered down the tubing string 14 on a wireline, or by other means known in the art.

Firing head 138 is retained in bore 134 by an expandable retaining ring 142, which snaps into annular groove 144 in the wall of bore 134. O-ring 146 seals between firing head 138 and the wall of bore 134. Threads 148 on firing sub 12 engage threads 150 on tubing string 14. Sub cover plate 152, held by retaining ring 154, covers the bottom of bore 134 below donor charge 92Δ.

DETAILED DESCRIPTION OF A SECOND PREFERRED EMBODIMENT

Figure 2:
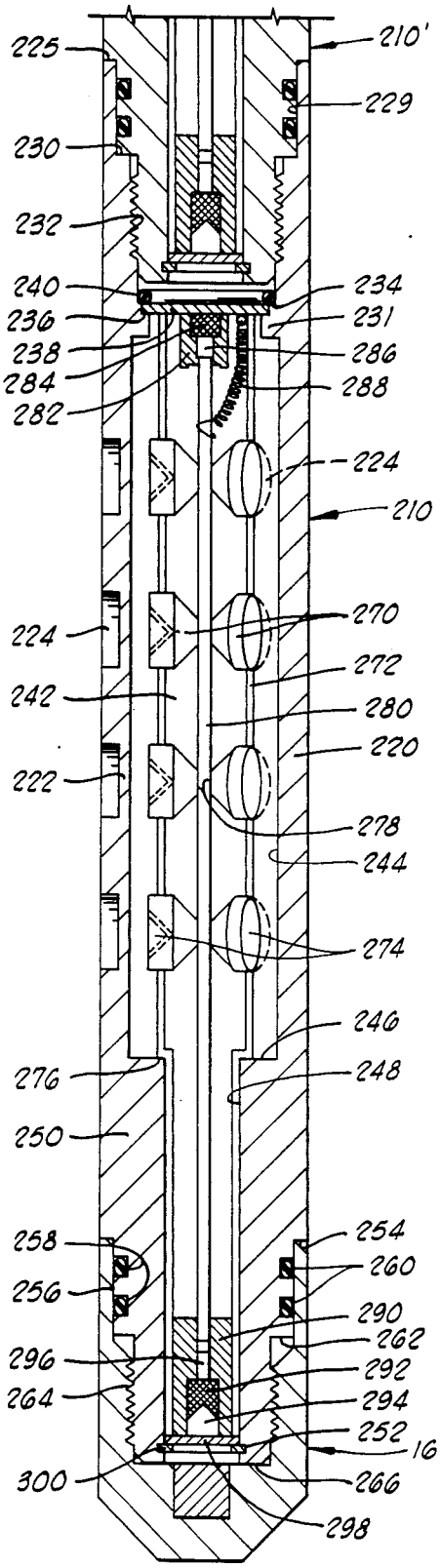
FIG. 2 is a full sectional schematic vertical elevation of a second preferred embodiment of the present invention.

Referring to FIG. 2 of the drawings, a second preferred embodiment of the present invention employing a slightly different structure is depicted.

Perforating gun 210 comprises a unitary tubular housing 220 having recesses 224 in the wall thereof, which recesses 224 serve as gun ports for the explosive jets emanating from shaped charges within gun 210.

At the top of gun 210, housing 220 possesses annular sealing surface 229 on the interior thereof. Sealing surface 229 terminates at inwardly-extending radial shoulder 230, below which internal threads 232 are cut into the inner wall of housing 220. Below threads 232 is inwardly radially extending annular shoulder 234, below which is another, smaller diameter annular shoulder 236, shoulders 234 and 236 being formed in inwardly extending annular protrusion 231. Circular top cover plate 238 abuts shoulder 236, and is maintained in place by a retaining means 240, which may comprise a large O-ring, a circular spring, a split ring, or other well known retaining means.

Cover plate 238 seals the top of charge chamber 242, which is defined by chamber bore wall 244 of housing 220, chamber 242 extending to annular shoulder 246 at the bottom of wall 244. Below annular shoulder 246, the wall of housing 220 is of increased thickness and the bore wall 248 of lesser diameter, extending through the lower end of housing 220, which may also be referred to as nose 250. Annular groove 252 opens into bore wall 248 proximate the end of nose 250. The exterior of nose 250 at its upper end is of substantially the diameter as the rest of housing 220, and has annular shoulder 254 thereon, below which is cylindrical surface 256 of lesser diameter into which O-ring grooves 258 open. Grooves 258 carry O-rings 260 therein. Below surface 256, shoulder 262 extends radially inwardly to external nose threads 264, which extend substantially to the bottom 266 of nose 250.

On the interior of housing 220, shaped charges 270 are secured in charge holder 272, which may comprise any construction known in the art. Cover plate 238 may be an integral part of charge holder 272. Charges 270 are shown oriented at 120° intervals, the mouths 274 of charges 270 being aimed by charge holder 272 at recesses 24 when charge holder 272 is fully inserted into housing 220, annular edge 276 abutting shoulder 246. However, as with the first preferred embodiment, charges 270 may be oriented at 90°, 72°, 180° or any other suitable intervals. The bottoms 278 of charges 270 are disposed substantially about the central axis of housing 220 in contact with detonating cord 280, which is disposed substantially on the axis of housing 220.

At the top of cord 280 is acceptor booster housing 282, which may be welded, brazed or otherwise secured to top cover plate 238. Booster housing 282 contains acceptor booster pellet 284, below which is booster 286, which is in contact with the upper end of detonating cord 280 clamped or otherwise secured by booster housing 282. Also attached to cover plate is one end of tension spring 288, the other end of which is secured to detonating cord 280 to maintain cord 280 in a substantially taut, unsagging state.

At the bottom of cord 280 is donor booster housing 290, which may be welded, brazed, riveted, screwed, bonded or otherwise secured to charge holder 272. Donor booster housing 290 possesses an axial bore therethrough, in which a small shaped charge 292, referred to as a donor charge, is disposed. The mouth of donor charge 292 is aimed downwardly, with a standoff gap 294 at the mouth thereof. The lower end of detonating cord 280 is clamped or otherwise secured proximate booster 296.

Immediately below and adjacent to donor booster housing 290 is circular bottom cover plate 298, which may or may not be secured to booster housing 290. Below cover plate 298 is expandable retainer ring 300, which snaps into annular recess 252.

Immediately below bottom cover plate 298 of perforating gun 210 is a bull plug 16, as previously described in FIG. 1B. At the top of gun 210 is the nose 250' of a second, substantially identical gun 210', guns 210 and 210' fitting together and operating together in the same manner as described with respect to guns 10 and 10'. Likewise, firing sub 12 as previously described in FIG. 1A may be employed to initiate the shaped charges in guns 210 and 210'.

It should be understood that the explosives employed in shaped charges 70, 70' and 270; booster pellets 84, 84' and 284; boosters 86, 86', 286, 96, 96', 96'' and 296; detonating cords 80, 80', 280 and 136; and donor charges 92, 92', 92'' and 292 comprise secondary explosive. Likewise, if firing head booster pellet 140 is to be initiated by a donor charge run downhole on a wireline, it too may comprise a secondary explosive. The use of such an allsecondary explosive perforating gun string possesses obvious safety advantages, particularly if booster pellet 140 is also of secondary explosive. Generally utilized secondary explosives include any of a number of known explosive compounds, including but not limited to cyclotrimethylenetrinitramine, hexahydro-1,3,5-trinitro-5-triazine, cyclonite, hexogen, T4, commonly referred to as RDX; octogen, known as HMX; or 2,2',4,4',6,6'-hexanitrostilbene, known as HNS. If the perforating string is to be employed in a high temperature (above 500° F.) well bore, the explosive compound 2,6-bis(Picrylamino)-3,5,dinitropyridine, known as PYX, may be employed.

Another advantage of the perforating gun of the present invention is the ability to preload each gun in a clean, dry, well-lighted factory rather than at the well site. The preloaded guns may then be transported to the well site, and made up together like drill pipe, there being no internal connections for the charge initiating means, even with respect to the firing sub at the top of the string. This use of preloaded, sealed guns also prevents water, dust, mud and other debris from intruding on the interior of the guns, even in foul weather. In addition, preloaded guns save considerable time at the well site, and, if needed, additional guns may be quickly secured from stock at the warehouse, camp, supply store or other distribution source. Furthermore, while the present invention is not so restricted, the entire gun may be made to be disposed of after use, and may then be made of more inexpensive materials and construction than if the guns were to be reused several times.

The assembly, or loading, of the perforating gun 10 of the present invention is exceedingly simple. Charge holder 72 may serve as a supporting structure for all internal components. Bottom cover plate 98 and donor booster housing 90 may be integral with holder 72. Likewise, acceptor booster housing 82 and top cover plate 38 may be integral with holder 72. Thus, shaped charges 70, booster pellet 84, booster 86, detonating cord 80, booster 96 and donor charge 92 may all be installed on charge holder 72, tension spring 88 affixed to cord 80, and charge holder 72 slid into housing 20. Retaining ring 40 may then be placed over top cover plate 38, and ring 100 over bottom cover plate 98. It is only necessary to ensure that each vertical row of charges 70 is oriented toward its respective aperture 24; this may be ensured by employing any known spline or key means between housing 20 and charge holder 72. Guns 10' and 210 may be assembled in a similar fashion.

In operation, after guns of the present invention are made up and run into the well bore, booster pellet 140 of firing sub 12 is initiated by any of the aforementioned initiating means. Pellet 140 in turn ignites detonating cord 136, which in turn initiates donor charge 92" through booster 96". The explosive jet from donor charge 92" pierces sub cover plate 152, and top cover plate 38, initiating acceptor booster pellet 84 in gun 10. Booster pellet, through booster 86, ignites detonating cord 80, which in turn initiates shaped charges 70. At the bottom of cord 80, booster 96 is actuated and initiates donor charge 92, which pierces bottom cover plate 100 of gun 10 and top cover plate 38' of gun 10'. The jet from donor charge 92 initiates acceptor booster pellet 84', and the above-described process continues to the bottom of gun 10, all charges 70' being initiated and donor charge 92' firing into bull plug 16 through bottom cover plate 100'. Guns 210 and 210' also operate in the above described manner.

It will be understood that more than two perforating guns of the present invention may be run in tandem, so as to obtain a gun string as long as is required to perforate the entire formation thickness. With a gun construction of the present invention, not only is safety increased in connecting guns, but reliability of the explosive train transfer is enhanced through use of relatively short detonating cord lengths in conjunction with the larger donor, acceptor and booster charges, which eliminates the possibility of faulty cord connections between guns.

Thus, there has been described a novel and unobvious modular perforating gun providing numerous and diverse advantages over the prior art. Of course, it will be evident to one of ordinary skill in the art that many additions, deletions and other modifications may be made to the gun of the preferred embodiment without departing from the spirit and scope of the claimed invention. For example, the guns may be secured together by fastening means other than threads; the O-rings may be carried inside the housing instead of on the nose; the charge holder may be of different design and hold a greater or lesser number of charges on each plane; and others.

I claim:

1. A modular perforating gun for use in a well bore, comprising:

tubular housing means for enclosing a plurality of shaped charges, said tubular housing means including:

an outer surface having a plurality of apertures therein;

a top end;

a lower end, below said top end when said modular perforating gun is oriented for insertion into the well bore;

a first inside diameter extending over a length of said tubular housing means from said top end substantially to said lower end;

a second inside diameter, less than said first inside diameter, proximate said lower end; and an upwardly facing annular shoulder, which is provided where said first inside diameter meets said second inside diameter;

tubular charge holder means, insertable into said tubular housing means, for holding said plurality of shaped charges, said charge holder means including an assembly having a first portion with an outside diameter substantially corresponding to said tubular housing means first inside diameter, and a second portion with an outside diameter substantially corresponding to said tubular housing means second inside diameter, such that a downwardly facing annular shoulder is provided between said first portion and said second portion, said downwardly facing annular shoulder abutting said upwardly facing annular shoulder when said charge holder means is inserted a predetermined distance into said tubular housing means such that said plurality of shaped charges are vertically aligned with said plurality of apertures;

connecting means, disposed proximate said top end and said lower end of said tubular housing means, for effecting a direct linear connection between at least two said tubular housing means; and explosive means for effecting perforation of said well bore, including:

said plurality of shaped charges;

firing means for providing a detonation wave;

acceptor charge means for transmitting said detonation wave, disposed at said top end of said tubular housing means;

detonating cord means for transmitting said detonation wave, extending from said acceptor charge means to said shaped charges and further extending to said lower end of said tubular housing means; and donor charge means for outputting said detonation wave, said donor charge means being downward-pointing and connected to an end of said detonating cord means said donor charge means being disposed proximate to said lower end of said tubular housing means.

2. A method for assembling a modular perforating gun, used in a well bore, said method comprising the steps of:

(a) providing a tubular housing for enclosing a plurality of shaped charges, said tubular housing including a first end with internal threads thereon, a second end with external threads thereon, a retainer disposed adjacent said first end, a plurality of apertures extending through said tubular housing, and an upwardly facing annular shoulder contained around an inside circumference of said tubular housing;

(b) providing a tubular charge holder assembly, for holding said plurality of shaped charges, said charge holder assembly including a downwardly facing annular shoulder around an outside circumference thereof;

(c) providing a sleeve for preventing fluids contained within said well bore from entering said apertures;

(d) inserting said charge holder assembly into said first end of said tubular housing such that said downwardly facing annular shoulder of said charge holder assembly abuts said upwardly facing annular shoulder of said tubular housing and said plurality of shaped charges are vertically aligned with said plurality of apertures;

(e) rotating said charge holder such that said plurality of shaped charges are circumferentially aligned with said plurality of apertures;

(f) disposing said retainer in said first end of said tubular housing such that the alignment of said charge holder within said tubular housing is maintained;

(g) disposing said sleeve around said tubular housing; and (h) linearly connecting at least two said tubular housings by engaging said external threads at said second end with said internal threads of said first end of another said tubular housing.

* * * * *